United States Patent [19]

Tanaka

[11] Patent Number: 4,932,110

[45] Date of Patent: Jun. 12, 1990

[54] APPARATUS FOR MAKING AN ELECTRIC HARNESS

[75] Inventor: Hiromi Tanaka, Machida, Japan

[73] Assignee: AMP Incorporated, Harrisburg, Pa.

[21] Appl. No.: 370,417

[22] Filed: Jun. 22, 1989

[30] Foreign Application Priority Data

Jul. 4, 1988 [JP] Japan ..... 63-166181

[51] Int. Cl.[5] ..... H01R 43/00

[52] U.S. Cl. ..... 29/33 M; 29/564.4; 29/749; 29/755; 29/857

[58] Field of Search ..... 29/33 M, 564, 564.4, 29/564.6, 568.8, 747, 749, 755, 825, 857, 861

[56] References Cited

U.S. PATENT DOCUMENTS 4,040,167 8/1977 Jepson et al. ..... 29/564.4
4,043,034 8/1977 Sucheski et al. ..... 29/747
4,779,328 10/1988 Hasegawa et al. .

FOREIGN PATENT DOCUMENTS 2187338 9/1987 United Kingdom .

*Primary Examiner*—Daniel Howell

[57] ABSTRACT

An electrical cable-making apparatus comprises a feeding device (16) for feeding a shielded ribbon electrical cable (11) and discrete electrical insulated conductors (12) from supply members (23,24) along a path (15), a clamping device (17) clamps onto the cable (11) and conductors (12) and moves the cable and conductors along the path a specified distance, clamping devices (18,20) move adjacent cutting and stripping members (**18*a*,19*a*) band clamp onto the cable and conductors, cutting blades (29*a*,29*b*) of the cutting and stripping members (19*a*,19*b*) cut the cable and conductors while the stripping blades (27*a*,27*b* and 28*a*,28*b*) cut through an outer jacket (11*e*) and shield (11*d*) of the cable (11) stripping the outer jacket and shield from the cable when the clamping devices (18,20) move in opposite directions exposing cable conductors (11*c*) of the cable (11) and forming trailing and newly-formed leading ends of the cable conductors (11*c*) and discrete conductors, the trailing and newly-formed conductor ends are positioned by the clamping devices (18,20) for termination by terminating devices (21*a*,21*b* and 22*a*,22*b*) to electrical contacts of electrical connectors (14,13'**).

8 Claims, 6 Drawing Sheets

APPARATUS FOR MAKING AN ELECTRIC HARNESS

FIELD OF THE INVENTION

The present invention relates to a cable-making apparatus for making electrical cable assemblies and more particularly to an apparatus for making electrical cable assemblies comprising discrete electrical conductors and a cable having shielded conductors with the ends of the discrete conductors and shielded conductors terminated to electrical contacts of electrical connectors.

BACKGROUND OF THE INVENTION

A cable-making apparatus is known to make electrical cable assemblies which have discrete electrical conductors with both ends of the conductors terminated to electrical contacts of electrical conductors. A cable-making apparatus is also known to make electrical cable assemblies which have the ends of the shielded conductors of a shielded cable terminated to electrical contacts of electrical connectors. In both types of cable assemblies, the electrical conductors are parallel to one another.

In certain types of electronic products, hybrid cable assemblies with discrete conductors and a cable with shielded conductors terminated to electrical contacts of connectors are being used. To use the cable-making apparatus for discrete insulated electrical conductors to terminate the ends thereof to the respective electrical contacts of the electrical connectors and then use the cable-making apparatus for shielded cable to strip the outer jacket and shield from the insulated electrical conductors to terminate the ends thereof to respective electrical contacts of the electrical connectors to make cable assemblies with discrete conductors and shielded conductors would have a negative effect on production costs and operations.

In order to carry out the operations to make the hybrid cable assemblies, the ends of the discrete conductors are terminated to insulation displacement termination sections of the electrical contacts without having to strip insulation from the ends of the conductors. To terminate the insulated conductors of the shielded cable, the outer jacket and the shield from both ends of the cable have to be stripped exposing the ends of the insulated conductors which are then terminated to the insulation displacement termination sections of the electrical contacts in the same manner as the discrete conductors. A pair of interacting striping members were used to ensure that cutting, stripping and terminating operations on the ends of the discrete conductors and the exposed ends of the shielded conductors were conducted at the same time and to ensure enough space was provided for these operations. However, due to the outer diameter of the shielded cable being larger than that of the discrete conductors and the shielded conductors and discrete conductors have to be the same diameter, the interacting stripping members of the conventional cable-making apparatuses could not be used.

SUMMARY OF THE INVENTION

An object of the present invention is to provide a cable-making apparatus which resolves the above-described problems.

According to the present invention, a cable-making apparatus comprises a feeding device for feeding a shielded electrical cable and discrete insulated electrical conductors, a movable clamp clamps onto the leading ends of the shielded cable and discrete conductors and moves the cable and conductors to a selected length, a cable-stripping and cable and conductor-cutting device strips an outer jacket and shield from trailing ends and newly-formed leading ends of the cable exposing insulated cable conductor ends which are cut along with the discrete conductors by the cutting-device, and a terminating device that terminates the trailing and leading exposed conductor ends of the shielded cable and the discrete conductors to respective electrical contacts of electrical connectors.

The stripping blades have aligned concave grooves extending inwardly from the bottom surfaces of the blades and corresponding to the number of insulated conductors of the shielded cable and the discrete conductors. When the stripping blades are moved toward each other, they cut through the outer jacket of the cable and into the shield until the bottom surfaces are in engagement, the aligned concave grooves thereby forming circular openings slightly larger in diameter than the shielded-insulated conductors and the discrete insulated conductors. Thus, only the ends of the shielded cable are stripped of outer jacket and shield.

BRIEF DESCRIPTION OF THE DRAWINGS

The invention, together with objects and advantages thereof, is best understood by way of example with reference to the following detailed description in conjunction with the accompanying drawings.

DETAILED DESCRIPTION OF THE INVENTION

Figure 1:
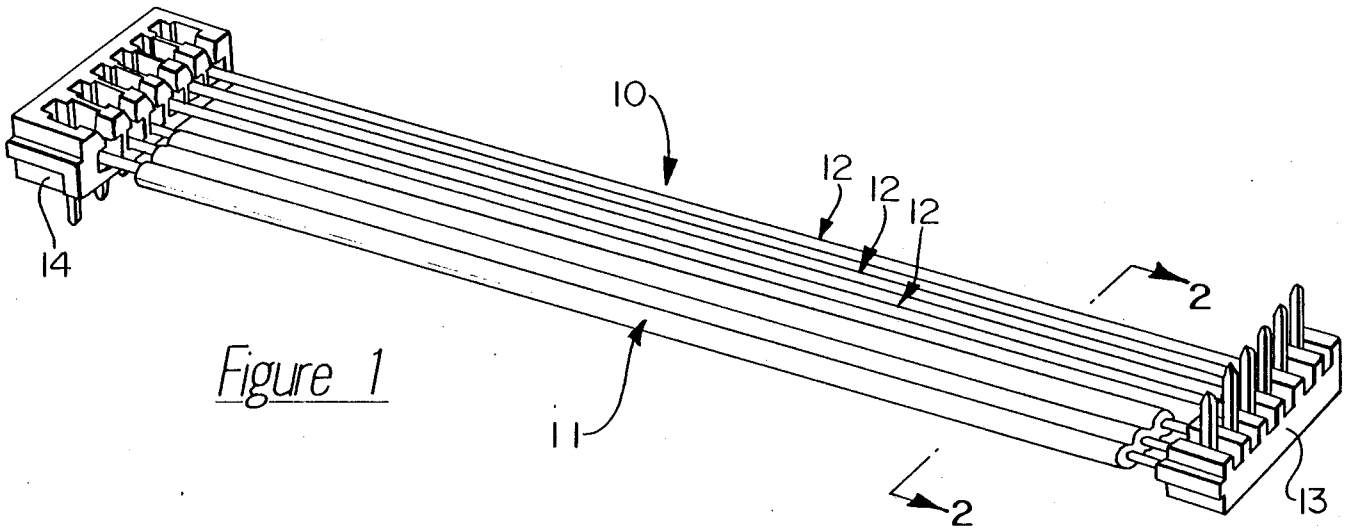
FIG. 1 is a perspective view of an electrical cable assembly made by the cable-making apparatus of the present invention.
Figure 2:
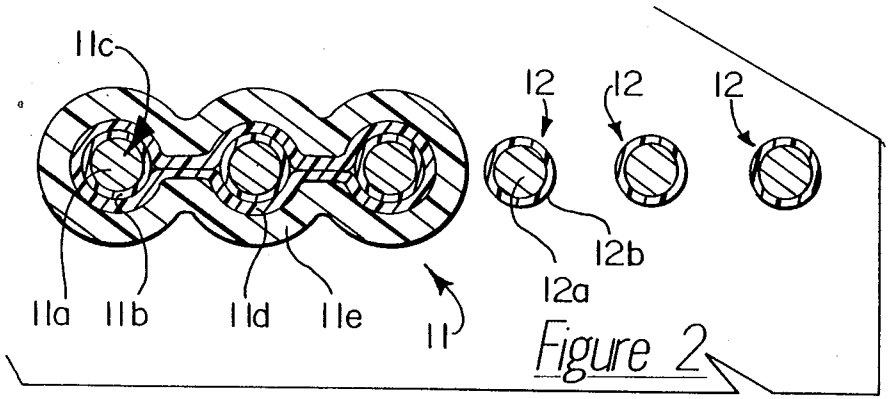
FIG. 2 is a cross-sectional view taken along line 2—2 of FIG. 1.

As shown in FIGS. 1 and 2, electrical cable assembly 10 comprises a shielded ribbon cable 11 and parallel discrete insulated conductors 12 having the exposed ends of the insulated cable conductors and the ends of the discrete conductors terminated to insulation displacement termination sections of conventional electrical connectors 13, 14.

Cable 11 is of conventional construction and includes a plurality of parallel electrical conductors **11*c* with a common metal shield which are disposed in an outer insulation jacket 11*e*. Each of cable conductors 11*c* has a conductive core 11*a* of solid or stranded construction covered by insulation 11b. Discrete electrical conductors 12 each have a conductive core 12a of solid or stranded construction covered by insulation 12b. The diameters of conductors 11c and 12 are the same which means that the ends of cable 11 have to be stripped of shield 11d and outer jacket 11e exposing the insulated ends of conductors 11c for termination to the contacts in connectors 13, 14**.

Figure 3:
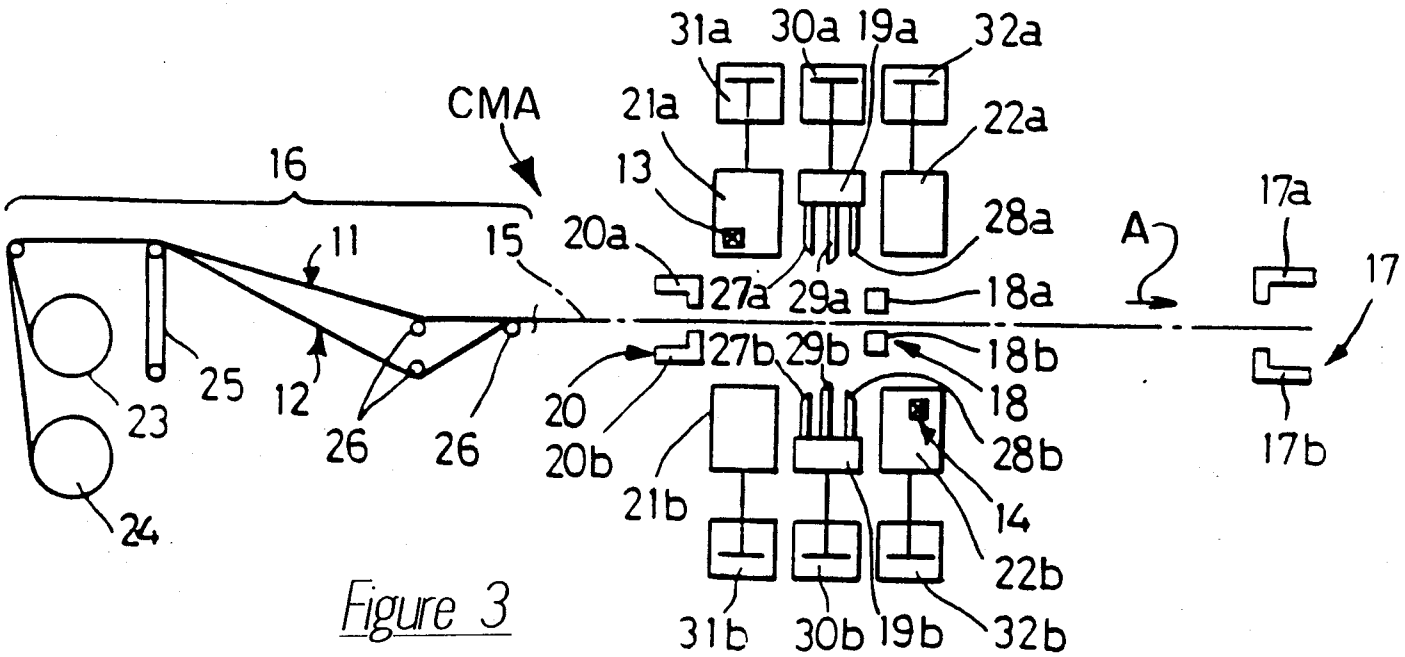
FIG. 3 is a schematic side elevational view of the cable-making apparatus.

FIG. 3 shows the various parts of a cable-making apparatus CMA which parts are of conventional construction and need not be shown and described in detail. Cable-making apparatus CMA includes a feeding device 16 which feeds shielded cable 11 and discrete conductors 12 along a path 15; clamping device 17 which clamps onto cable 11 and conductors 12 to move them along path 15 in the direction of arrow A to a selected length; a pair of cutting and stripping members 19a, 19b to cut the cable 11 and conductors 12 and strip the outer jacket 11e and shield 11d from the trailing and newly-formed leading ends of cable 11 exposing the ends of conductors 11c; clamping device 18 which clamps onto the trailing ends of cable 11 and conductors 12 to move them along path 15 in the direction of arrow A; clamping device 20 which clamps onto the newly-formed leading ends of cable 11 and conductors 12 to move them along path 15 in the direction of arrow B (FIG. 6B); terminating device 21a, 21b terminates the newly-formed leading ends of conductors 11c, 12 to the electrical contacts of connector 13; and terminating device 22a, 22b terminates the trailing ends of conductors 11c, 12 to the electrical contacts of connector 14.

Feeding device 16 is equipped with supply rolls 23, 24 for supply cable 11 and discrete conductors 12, stand 25 and rollers 26 which orient and guide cable 11 and conductors 12. Clamping devices 17, 18, 20 have clamping members 17a, 17b; 18a, 18b and 20a, 20b that move into and out of clamping engagement with cable 11 and conductors 12 as well as being movable along path 15. The clamping devices can be operated by fluid-operated cylinders or by other well-known mechanisms.

The cutting and stripping members 19a, 19b are equipped with pairs of stripping blades 27a, 27b; 28a, 28b and cutting blades 29a, 29b. They are moved downwards via fluid pressure mechanisms 30a, 30b.

Figure 10:
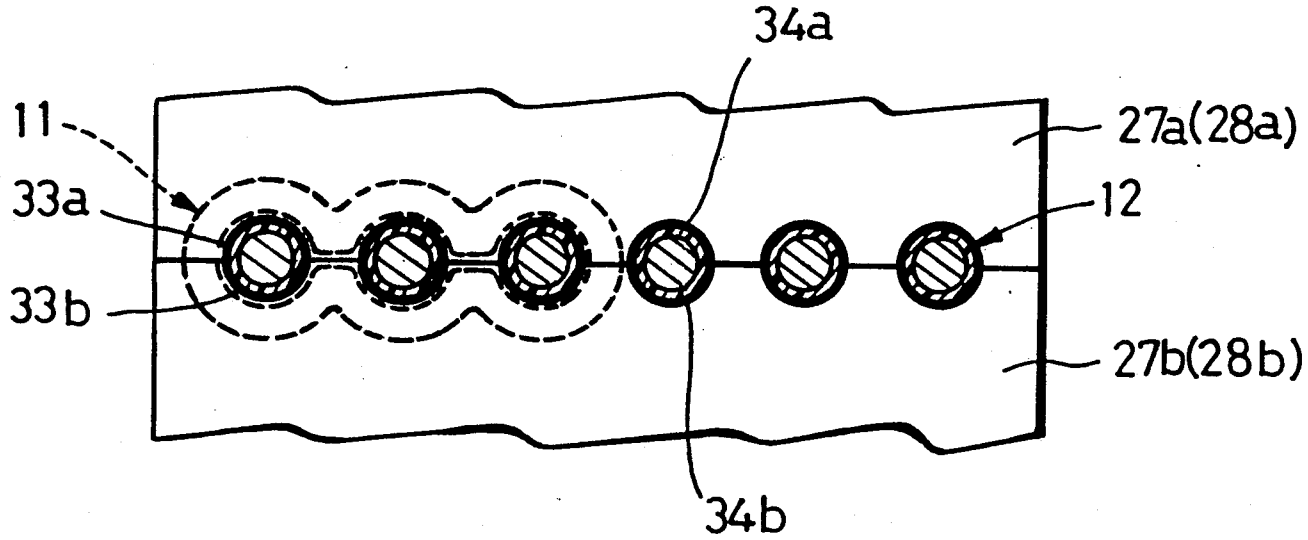
FIG. 10 is a view similar to FIG. 9 showing the stripping blades in operation.

As shown in FIGS. 9–12, stripping blades 27a, 27b and 28a, 28b are provided with aligned concave sections 33a, 33b and 34a, 34b that extend inwardly from the bottom surfaces of the blades. The blade bottom surfaces when engaged, as shown in FIG. 10, form circular openings which have a diameter slightly larger than the outside diameter of the insulation 11b and 12b of conductors 11c and 12. As a result, only the outer jacket 11e and shield 11d of cable 11 are cut via stripping blades 27a, 27b and 28a, 28b and aligned concave sections 33a, 33b, which correspond to the number of conductors 11c in cable 11, and aligned concave sections 34a, 34b, which correspond to the number of conductors 12, do not cut into insulation 11b and 12b thereof, as shown in FIG. 10.

Figure 11:
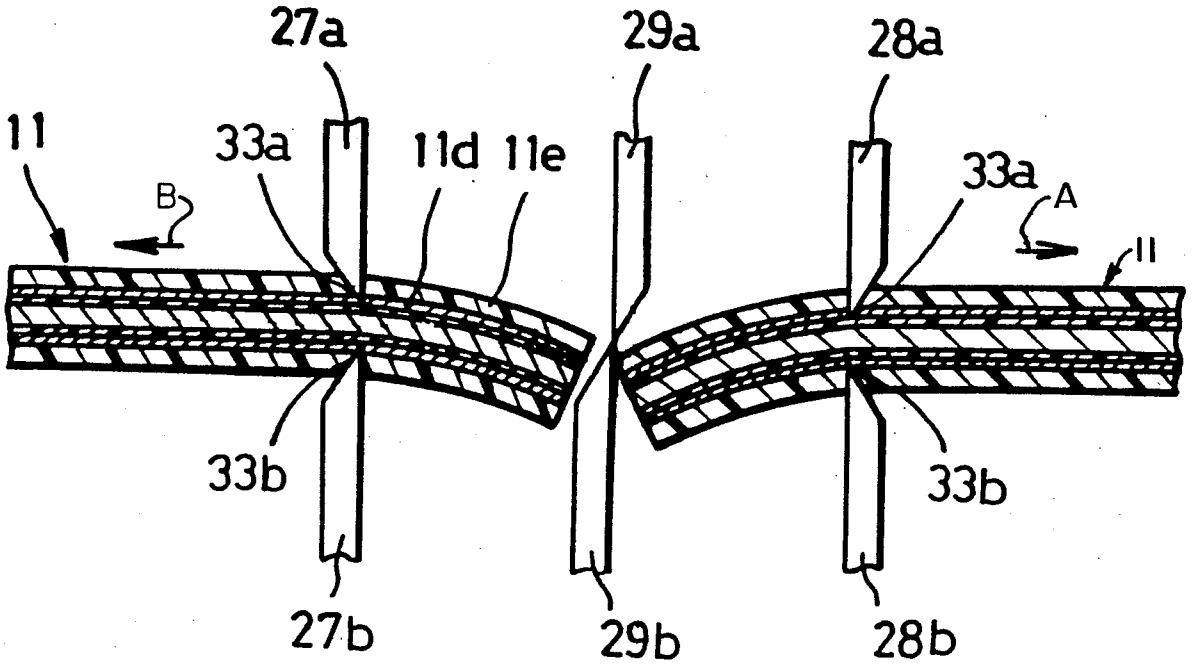
FIGS. 11 and 12 are a cross section of the shielded cable and the operation of the stripping and cutting blades.
Figure 12:
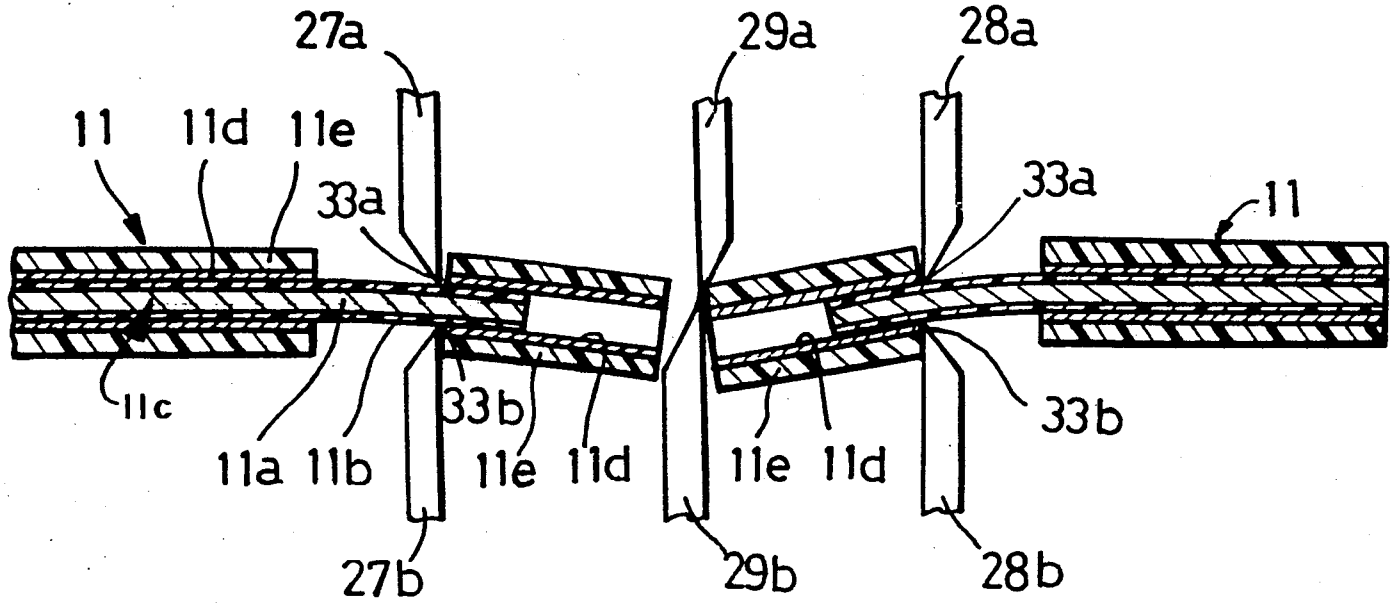

As shown in FIG. 11, with cutting blades 29a, 29b cutting cable 11 and conductors 12 and stripping blades 27a, 27b and 28a, 28b cutting through outer jacket 11e and shield 11d of cable 11, movement of cable 11 and conductors 12 in the direction of arrows A, B will cause cable 11 to be stripped, as shown in FIG. 12, thereby exposing the ends of conductors 11c.

Figure 13:
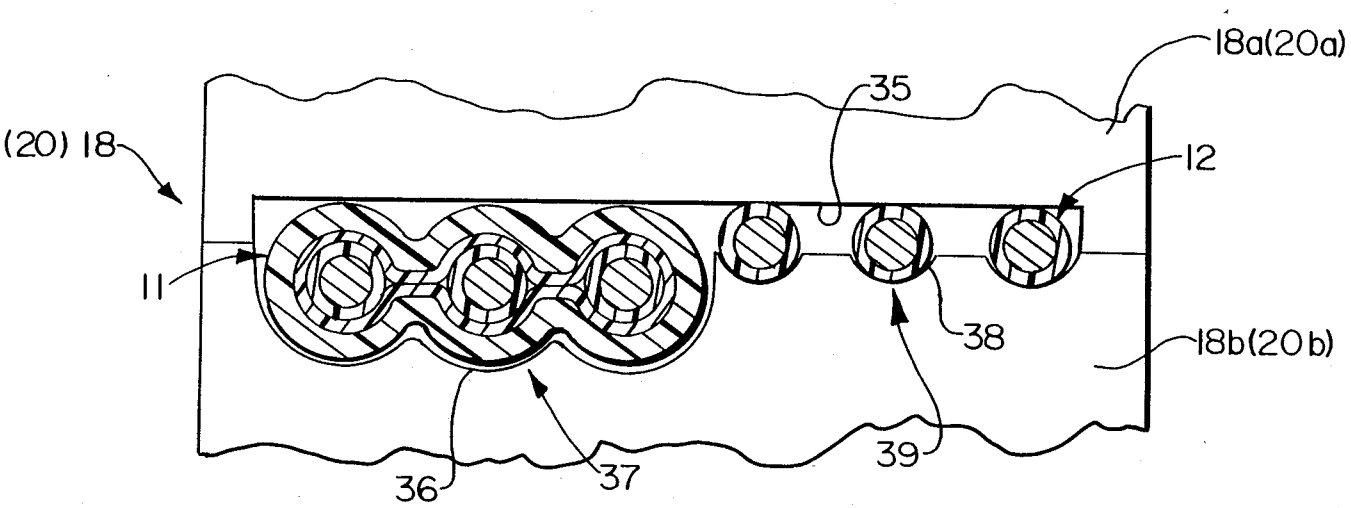
FIG. 13 is a front elevational view of the clamp members with cross-sections of the shielded cable and discrete conductors clamped therein.

As shown in FIG. 13, clamping members 18a, and 20a of clamping devices 18, 20 have a recess 35 whereas clamping members 18b and 20b have cable-retaining section 37 and conductor-retaining section 39. Cable-retaining section 37 has channel 36 configured to accommodate cable 11, and conductor-retaining section 39 includes spaced grooves 38 in which conductors 12 are disposed. When the clamping devices are closed, cable 11 and conductors 12 are clamped therein for moving cable 11 and conductors 12 along path 15.

Clamping members 17a, 17b of clamping device 17 need not be constructed as that of the clamping members of clamping devices 18, 20 as clamping members 17a, 17b can engage connector 13; however, they can also have the same construction to engage cable 11 and conductors 12, if desired.

Terminating devices 21a, 21b and 22a, 22b are operated by fluid-operated cylinders 31a, 31b and 32a, 32b to terminate the exposed ends of conductors 11c and the ends of conductors 12 to the insulation displacement termination sections of the electrical contacts of connectors 13, 14.

Figure 4:
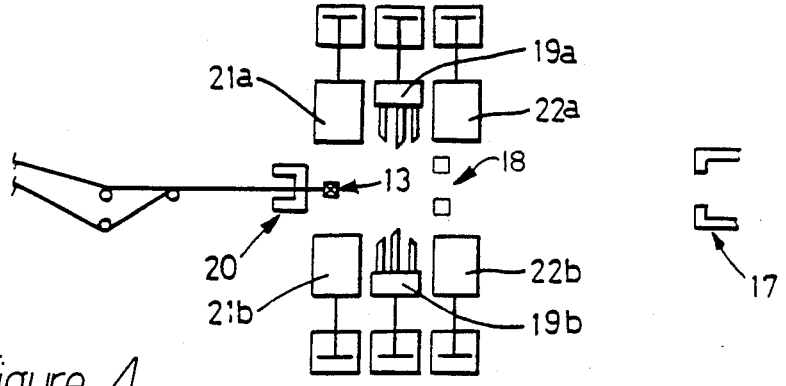
FIGS. 4–8 are schematic views showing the various operations by the cable-making apparatus in making the electrical cable assemblies.

FIG. 4 shows the cable-making apparatus in its initial phase of operation. Clamping device 17, cutting and stripping members 19a and 19b, clamping device 18 and terminating devices 21a, 21b and 22a, 22b are in their original positions. It is to be noted that clamping device 20 is clamped onto cable 11 and conductors 12 and the newly-formed leading ends of conductors 11c and conductors 12 have been terminated to the electrical contacts of electrical connector 13.

Figure 5:
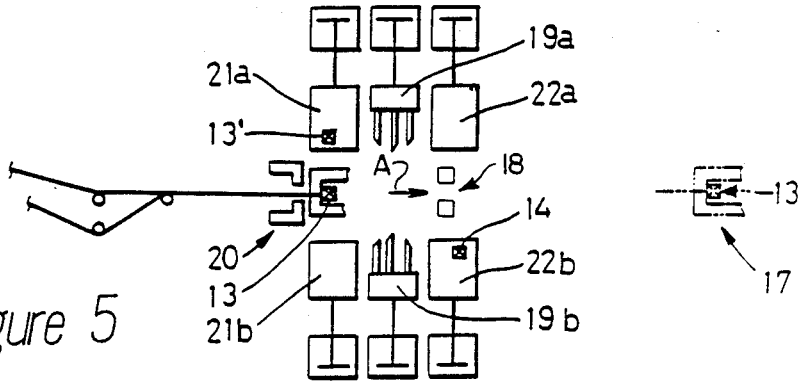

As shown in FIG. 5, clamping device 17 has moved to the left and clamped onto the cable 11 and conductors 12 whereafter clamping device 17 moves to the right to a selected position, as shown in broken lines, and connectors 13', 14 are positioned in terminating devices 21a and 22b for termination to the trailing and newly-formed ends of conductors 11c and 12.

Figure 6A:
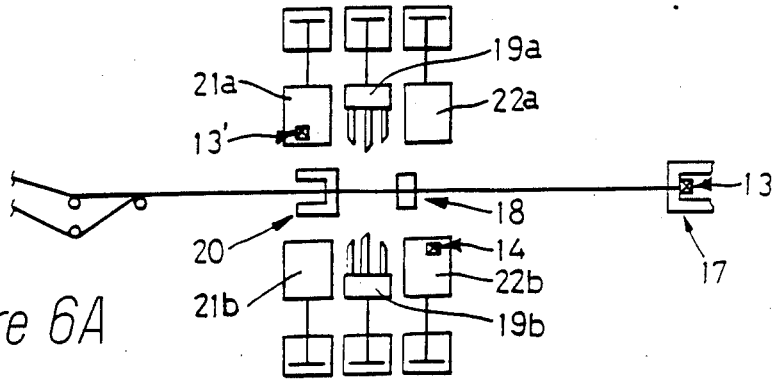
Figure 6B:
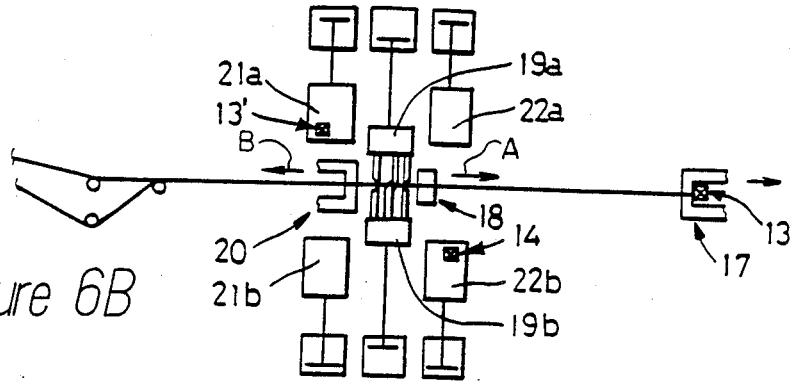
Figure 6C:
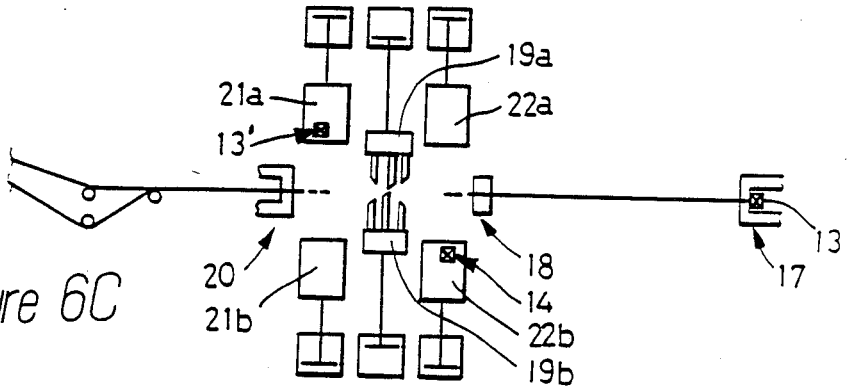

FIGS. 6A–6C show the cable assembly length measuring and cutting and stripping operations. As shown in FIG. 6A, clamping device 17, which is clamped onto cable 11 and conductors 12 behind connector 13, moves to the right a specified distance. Clamping device 20 moves to the right, is positioned adjacent stripping blades 27a, 27b and is clamped onto cable 11 and conductors 12. Clamping device 18 also clamps onto cable 11 and conductors 12 adjacent stripping blades 28a, 28b. Cutting and stripping members 19a, 19b move toward one another so that cutting blades 29a, 29b cut cable 11 and conductors 12, and, at the same time, stripping blades 27a, 27b and 28a, 28b cut through outer jacket 11e and shield 11d of cable 11 while clamping devices 17 and 18 move a short distance in the direction of arrow A thereby positioning the trailing ends of exposed conductors 11c and conductors 12a termination to the electrical contacts of connector 14 and clamping device 20 moves in the direction of arrow B thereby positioning the newly-formed leading ends of exposed conductors 11c and conductors 12 for termination to the electrical contacts of connector 13'.

Figure 7A:
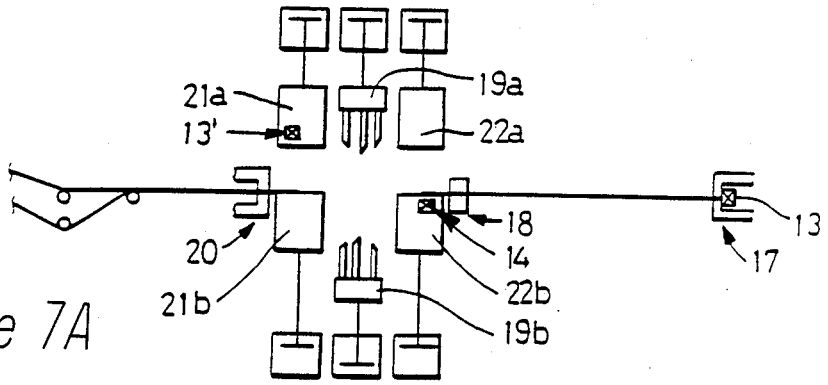
Figure 7B:
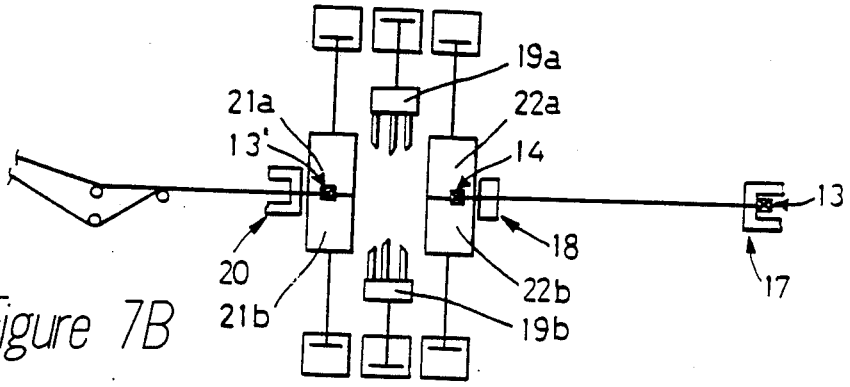

FIG. 7A shows terminating devices 21b, 22b being moved upwardly so that combs or aligning members (not shown) thereon properly align exposed conductors 11c and conductors 12 while cutting and stripping members 19a, 19b are moved to their original positions. As shown in FIG. 7B, terminating devices 21a, 22a move downwardly terminating the exposed conductors 11c and conductors 12 to respective electrical contacts of connectors 13', 14.

Figure 8:
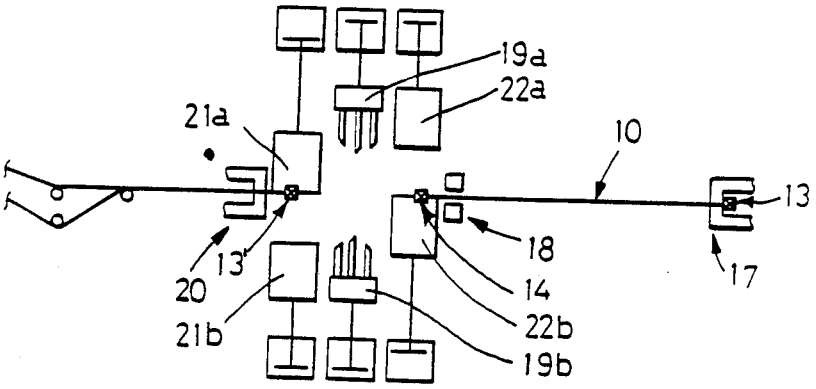
Figure 9:
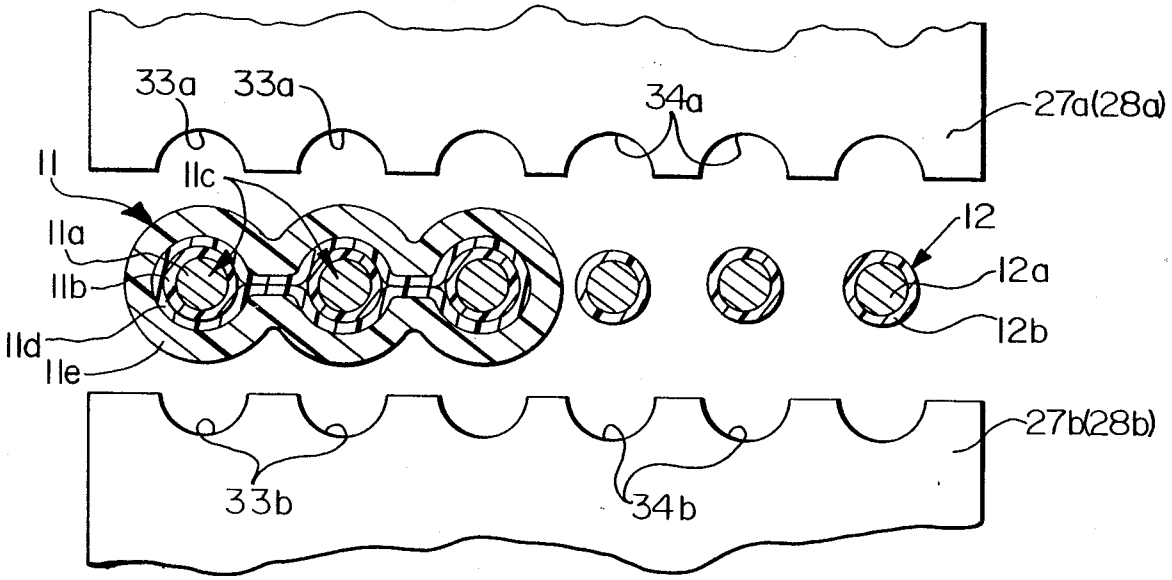
FIG. 9 is a front elevational view of the stripping sections of the stripping blades and a cross-section of the shielded cable and discrete electrical conductors prior to operation of the stripping blades.

As shown in FIG. 8, terminating devices 21*b*, 22*a* move to their original positions and clamping device 18 is opened and completed cable assembly 10 is moved to the right by clamping device 17 where it is discharged. The cable-making apparatus returns to the position as shown in FIG. 4 and repeats the above-described operations to continuously make the electrical cable assemblies.

A cable-making apparatus has been disclosed for continuously making electrical cable assemblies that include a shielded ribbon cable and discrete electrical conductors that have exposed ends of the cable conductors and the ends of the discrete conductors terminated to respective electrical contacts of electrical connectors. The apparatus includes stripping blades that strip the ends of the shielded ribbon cable of the outer jacket and shield thereby exposing ends of the cable conductors while not stripping insulation from the cable conductors and discrete conductors.

I claim:

1. An electrical cable-making apparatus for making an electrical cable assembly of the type having a shielded ribbon electrical cable and discrete insulated electrical conductors with the exposed ends of the cable conductors and the ends of the discrete conductors terminated to electrical contacts of electrical connectors comprising a feeding device for feeding the leading ends of the shielded electrical cable and the discrete conductors along a path, a clamping device for clamping onto the cable and conductors and pulling the cable and conductors along the path to a specified length, cutting and stripping members for cutting the cable and discrete conductors and stripping an outer jacket and shield from the cable exposing trailing ends and newly-formed leading ends of the cable conductors, and terminating devices for terminating the trailing and newly-formed ends of the cable conductors and discrete conductors to electrical contacts of electrical connectors, characterized in that:

stripping blades have bottom surface ends and aligned concave grooves extending inwardly from said bottom surfaces of the stripping blades, the aligned grooves corresponding to the cable conductors of the cable and the discrete conductors, the stripping blades moving toward one another cutting through an outer jacket and shield of the cable until the bottom surfaces are in engagement whereby the aligned grooves form holes having a diameter slightly greater than the diameters of the cable conductors and discrete conductors.

2. An electrical cable-making apparatus as claimed in claim 1, characterized in that a plurality of clamping devices clamp onto the cable and discrete conductors adjacent the stripping blades to enable the cutting and stripping members to cut the cable and discrete conductors and strip the cable to expose cable conductors and the clamping devices are movable in opposite directions to position the trailing and newly-formed leading ends of the cable conductors and discrete conductors in alignment with the contacts of connectors and the terminating devices terminate the trailing and newly-formed leading ends of the cable and discrete conductors to the contacts of the connectors.

3. An electrical cable-making apparatus as claimed in claim 1, characterized in that said clamping devices have an upper clamping member including a recess and a lower clamping member having a channel to accommodate the cable and spaced grooves to accommodate the discrete conductors.

4. An electrical cable-making apparatus for making electrical cable assemblies of the type having a ribbon shielded electrical cable and discrete insulated electrical conductors with the exposed ends of the cable conductors and the ends of the discrete conductors terminated to electrical contacts of electrical conductors, the apparatus comprising:

a feeding device for feeding the ribbon cable and the discrete conductors from supply members;

a clamping device for clamping onto the cable and conductors and moving a specified distance along a path;

cutting and stripping members positioned above and below the path;

a plurality of clamping devices movable to a position adjacent the cutting and stripping members and clamping onto the cable and discrete conductors;

cutting blades and stripping blades of the cutting and stripping members being movable toward each other cutting the cable and the conductors while the stripping blades cut through an outer jacket and shield of the cable and strip ends of the outer jacket and shield from the cable exposing ends of cable conductors thereby forming trailing and newly-formed leading ends of the cable conductors and the discrete conductors, the clamping devices being movable in opposite directions thereby positioning the trailing and newly-formed leading ends of the cable conductors and the discrete conductors in position with terminating sections of electrical contacts of electrical connectors; and terminating devices for terminating the trailing and newly-formed leading ends of the cable conductors and discrete conductors to the terminating sections of the electrical contacts of the electrical connectors.

5. An electrical cable-making apparatus as claimed in claim 4, wherein the stripping blades have bottom surface ends and aligned grooves extending inwardly from the bottom surfaces corresponding to the number of cable conductors and discrete conductors, the aligned grooves forming circular holes when the bottom surfaces of the blade members engage each other which have a diameter slightly larger than the diameter of the cable conductors and discrete conductors.

6. An electrical cable-making apparatus as claimed in claim 4, wherein the clamping devices include upper clamping members having a recess and lower clamping members having a channel to accommodate the cable and spaced grooves to accommodate the discrete conductors.

7. A method of making an electrical cable assembly of the type having a shielded electrical cable and discrete insulated electrical conductors with the exposed ends of the cable conductors and the ends of the discrete conductors terminated to electrical contacts of electrical connectors comprising the steps of:

feeding leading ends of the shielded electrical cable and the discrete conductors along a path to a selected position;

moving clamping members onto the cable and conductors at spaced locations;

operating cutting and stripping members positioned between the clamping members with the cutting members cutting the cable and conductors and the stripping members cutting through an outer jacket and shield of the cable without cutting the insulation of the insulated cable conductors and the discrete insulated conductors thereby forming trailing and newly-formed leading ends of the cable and discrete conductors;

moving the clamping members while still in engagement with the cable and conductors in opposite directions thereby stripping the outer jacket and shield from the trailing and newly-formed ends of the cable and exposing trailing and newly-formed leading ends of the cable and positioning the trailing and newly-formed leading ends of the exposed cable conductors and discrete conductors in alignment with the electrical contacts of respective electrical connectors; and terminating the trailing and newly-formed leading ends of the exposed cable conductors and discrete conductors in the electrical contacts of the respective electrical connectors.

8. A method as claimed in claim 7, comprising the further steps of:

releasing the clamping members from the cable and conductors;

moving a clamping member from the selected position onto the cable and conductors adjacent the newly-formed leading ends; and moving the clamping member and the newly-formed leading ends with the connector terminated thereto to a selected position.

* * * * *

UNITED STATES PATENT OFFICE

CERTIFICATE OF CORRECTION

Patent No. 4,932,110 Dated June 12, 1990

Inventor(s) Hiromi Tanaka

It is certified that error appears in the above-identified patent and that said Letters Patent is hereby corrected as shown below:

In the Abstract:

Line 9 - "18a, 19a" should be --19a, 19b-- and the word "band" should be the word --and--.

Signed and Sealed this

Fourteenth Day of January, 1992

*Attest:*

HARRY F. MANBECK, JR.

*Attesting Officer*

*Commissioner of Patents and Trademarks*